US005482019A

United States Patent [19]

Ausiello et al.

[11] Patent Number: 5,482,019

[45] Date of Patent: Jan. 9, 1996

[54] ENGINE CONTROL SYSTEM WITH MOTORIZED BUTTERFLY BODY

[75] Inventors: Francesco P. Ausiello, Bologne, Italy; Olivier Quelenis, Rueil-Malmaison; Philippe Wallerand, Sartrouville, both of France

[73] Assignees: Solex, France; Weber SRL, Italy

[21] Appl. No.: 256,191

[22] PCT Filed: Oct. 26, 1993

[86] PCT No.: PCT/FR93/01046

§ 371 Date: Jun. 28, 1994

§ 102(e) Date: Jun. 28, 1994

[87] PCT Pub. No.: WO94/10434

PCT Pub. Date: May 11, 1994

[30] Foreign Application Priority Data

Oct. 29, 1992 [FR] France ..... 92 12931

[51] Int. Cl.[6] ..... F02D 41/00

[52] U.S. Cl. ..... 123/361

[58] Field of Search ..... 123/361, 336, 123/360, 399, 357; 180/178

[56] References Cited

U.S. PATENT DOCUMENTS

| | | | |
|---|---|---|---|
| 4,819,597 | 4/1989 | Gale et al. | 123/399 |
| 4,894,781 | 1/1990 | Sato et al. | 364/431.1 |
| 4,896,640 | 1/1990 | Pfalzgraf et al. | 123/399 |
| 4,926,821 | 5/1990 | Porth et al. | 123/399 |
| 5,035,213 | 7/1991 | Pfalzgraf et al. | 123/336 |
| 5,056,613 | 10/1991 | Porter et al. | 180/178 |
| 5,086,740 | 2/1992 | Wiggins et al. | 123/361 |
| 5,093,793 | 3/1992 | Suzuki | 364/431.03 |
| 5,113,822 | 5/1992 | Asayama | 123/360 |
| 5,232,746 | 6/1994 | Best et al. | 123/357 |
| 5,293,855 | 3/1994 | Nakamura | 123/399 |
| 5,372,110 | 12/1994 | Boverie et al. | 123/361 |

FOREIGN PATENT DOCUMENTS

| | | | |
|---|---|---|---|
| 0222081 | 5/1987 | European Pat. Off. | 123/361 |
| 0300153 | 1/1989 | European Pat. Off. | 123/361 |
| 0536557 | 4/1993 | European Pat. Off. | 123/361 |
| 3539407 | 5/1987 | Germany | 123/361 |
| 4106257 | 9/1992 | Germany | 123/361 |

*Primary Examiner*—Raymond A. Nelli
*Attorney, Agent, or Firm*—Larson and Taylor

[57] ABSTRACT

An engine control system for a spark ignition internal combustion engine of a vehicle equipped with a fuel injection system, including a motorized butterfly unit having a body, a butterfly rotatably mounted on a spindle in a passage through the body, a butterfly position sensor mounted on one end of the spindle and a butterfly actuator mounted on the other side of the spindle. An engine control unit, which is connected to sensors for detecting engine operation parameters and to the accelerator pedal, generates injection and ignition commands as well as a reference position of the butterfly, which is transmitted by a connecting line to the butterfly control unit. The butterfly control unit sets the position of the butterfly to the reference position and transmits the butterfly position signal via the connecting line to the engine control unit.

21 Claims, 1 Drawing Sheet

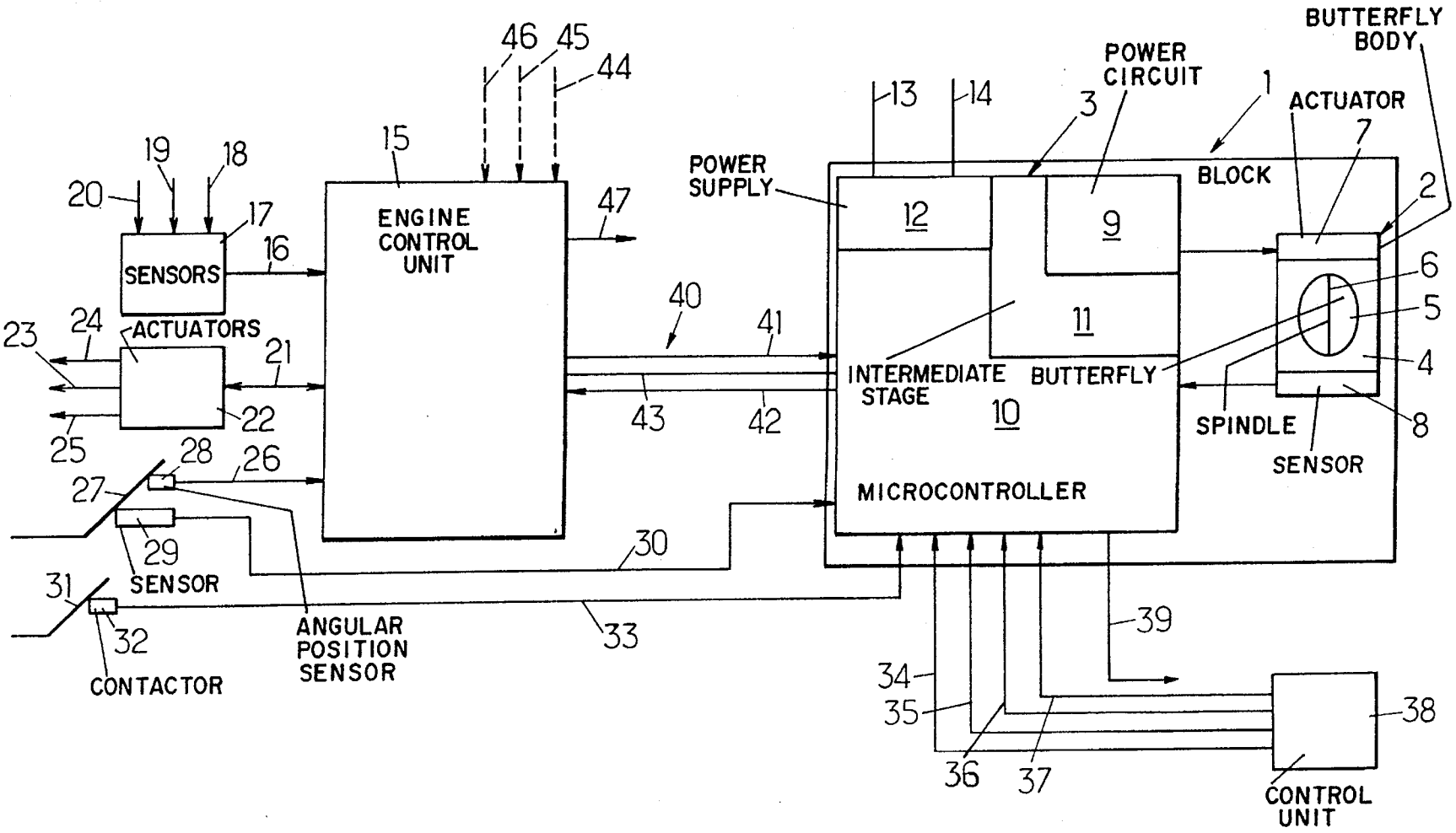
BUTTERFLY BODY
ACTUATOR
BLOCK
SENSOR
SPINDLE
CONTROL UNIT
POWER CIRCUIT
BUTTERFLY
INTERMEDIATE STAGE
MICROCONTROLLER
POWER SUPPLY
ENGINE CONTROL UNIT
SENSORS
ACTUATORS
ANGULAR POSITION SENSOR
SENSOR
CONTACTOR

ENGINE CONTROL SYSTEM WITH MOTORIZED BUTTERFLY BODY

BACKGROUND OF THE INVENTION

1. Field of the Invention

The invention relates to an engine control system with a motorized butterfly body for a motor vehicle internal combustion engine equipped with a fuel injection system.

2. Description of the Prior Art

In the most conventional fuel injection systems currently equipping motor vehicle spark ignition internal combustion engines, at least one shut off member, termed butterfly, mounted so that it can pivot on a spindle in a duct of a butterfly body is connected to the accelerator pedal by a cable-operated mechanical transmission making it possible to regulate the angular position of the butterfly in the duct in order to cause the flowrate of intake air to the engine to vary, as a function of the demand from the driver. Simultaneously, modern spark ignition engines are equipped with an electronic control and monitoring unit, termed engine control unit, which comprises a computer and which has the function of controlling and monitoring the operation of the ignition circuit and of the fuel injection circuit of the engine. This engine control unit is connected to several sensors for sensing operating parameters of the engine, from which it receives signals which represent in particular the engine speed, the position of the shaft of the engine, the air pressure in the intake manifold, as well as possibly the temperature of the air and the temperature of the water in the cooling circuit, without this list being limiting. On the basis of the signals received from the sensors to which this engine control unit is connected, as well as possibly on the basis of data recorded in memories of this unit, the latter formulates orders for controlling the ignition and injection circuits, which it transmits to actuators of these circuits, such as the windings of injectors, a fuel pump, and ignition coils, in order to activate them. So that the operation of the ignition and injection circuits can be controlled suitably, under certain configurations of use of the engine, particularly during cold starts and when operating at low idle, as well as in a way which is coherent with the control of the air supply circuit, so that it results from the demand from the driver, the angular position of the butterfly is detected by a sensor transmitting a corresponding signal to the engine control unit, which takes this signal into account not only to formulate the control signals which it transmits to the actuators of the ignition and injection circuits, but also to formulate a control signal which it transmits to an actuator, such as an electric stepper motor for maneuvering a valve, mounted in an air intake circuit as a bypass round the butterfly, for the phases for which the engine is starting-up and operating at low idle.

Moreover, it is also known how to equip motor vehicles with installations for safety or driver comfort, for example with a system for preventing wheelspin, a system for preventing the wheels from locking up, or even with a system for setting the speed of the vehicle to a speed chosen by the driver. Each of these systems also comprises an electronic control and monitoring unit, which receives information from appropriate sensors, witnessing the operating state of the vehicle and of some of its components, and which prepares, on the basis of this information, control orders transmitted to appropriate actuators. For each of the particular systems mentioned hereinabove, one of the appropriate actuators is an actuator, for example an electric motor, which regulates the angular position of the butterfly, in parallel with the mechanical control by means of cable connecting this butterfly to the accelerator pedal, the actuator for the system preventing wheelspin or for the antilock system having, for obvious reasons of safety, priority over the control exerted by the driver by action on the accelerator pedal.

However, outside the periods for which the safety systems (antiwheelspin, antilock) intervene, the regulation of the air taken in remains under the direct control of the driver, through his action on the accelerator pedal. This leads, in particular, to an engine torque which is controlled to a greater or lesser extent at the driving wheels, as well as to a variable behavior of the vehicle during transient conditions. In order to overcome this drawback it has been proposed to substitute for the mechanical transfer law between the position of the accelerator pedal and the position of the butterfly, a programmable transfer law, incorporating a function for dynamic correction of the butterfly as well as a function for controlling the progressive nature of its angular movement, and finally a setting of the low idle speed. It has consequently been proposed to install, between the accelerator pedal and the butterfly, an additional control and monitoring unit including a computer, as well as an additional actuator, such as an electric motor, the additional control unit receiving a signal from a sensor for sensing the angular position of the accelerator pedal and formulating, taking account of this signal, a signal for controlling the actuator, which maneuvers the butterfly.

In order to simplify such an installation which comprises, for maneuvering the butterfly, at least two different actuators, one of which, controlled directly by the engine control unit, comes into play during cold starts and for setting the low idle speed, and the other of which is an actuator controlled from the control unit and sensitive to the position of the accelerator pedal, and calling upon the functions of dynamic correction and progressiveness, to which there may be added a third or even a fourth actuator belonging respectively to the system for setting the speed and the system for preventing wheelspin, it has recently been proposed to regulate the position of the butterfly with the aid of a single actuator, itself controlled by its own electronic control and monitoring unit, termed control unit of the butterfly, formulating the transfer law between the position of the accelerator pedal and that of the butterfly, not only on the basis of a signal for recopying the angular position of the accelerator pedal, this signal being received from a corresponding sensor, but also of a signal received from the engine control unit, to which the control unit of the butterfly is connected by a communication line, as well as of signals received from appropriate contactors, for example of the system for setting the speed of the vehicle, in order to place the butterfly in a position making it possible to maintain the chosen speed, and possibly from the system for preventing wheelspin, in order to close the butterfly again if need be.

Furthermore, in such an installation, the single actuator for the butterfly and the sensor for sensing the angular position of the butterfly have already each been incorporated into the butterfly body.

In this case, the control unit of the butterfly is directly connected, on the one hand, to the actuator of the butterfly, which it controls by means of an electronic power circuit and, on the other hand, to the sensor for sensing the angular position of the butterfly, originating from which a signal about the angular position of the butterfly is received by a circuit for automatically controlling the butterfly in terms of position, this circuit being provided in the control unit of the butterfly in order to compare the said signal about the angular position of the butterfly with at least one position reference signal and in order to formulate, on the basis of an error signal resulting from this comparison, an order for regulating the position of the butterfly, which is transmitted to the power circuit.

The drawback of such an installation is that the control of the butterfly is provided for solely by the control unit of the butterfly, so that any failure of this unit, or of the communication line via which it receives information from the engine control unit, is a factor detracting from safety. This lack of safety as regards closure of the butterfly, in order to decrease the power of the engine, is found also as regards the monitoring of the demand from the driver, which is provided for solely by the sensor for sensing the position of the accelerator pedal, this being directly connected to the control unit of the butterfly. Likewise, the monitoring of the position of the butterfly is provided for solely by the corresponding sensor, directly connected to the control unit of the butterfly.

SUMMARY OF THE INVENTION

Through the present invention, it is proposed to overcome the drawbacks of the engine control systems with motorized butterfly bodies of the type explained hereinabove, and the object of the invention is to propose such a control system exhibiting improved safety, from the double point of view of the architecture adopted and of the components used in order to achieve it, and better suiting the various practical requirements than the known systems of the state of the art.

More precisely, on this subject, a specific object of the invention is to propose such a system in which redundancies are provided not only in order to monitor the position of the butterfly, the demand from the driver, the correct operation of one and/or the other of the two control units, but also in order to decrease the power of the engine if need be, even if the communication line between the two control units is cut.

Another object of the invention is to propose an engine control system with motorized butterfly body making it possible to group together into the engine control unit all the functions of managing the air, fuel and ignition circuits of the engine.

Yet another object of the invention is to propose such an engine control system with motorized butterfly body, of a structure such that its cost can be sufficiently limited to allow an application to motor vehicles starting from the middle of the range, and not just at the top of the range.

Finally, another object of the invention is to propose such an engine control system, in which it is advantageously possible to use all the pins available on connectors, with which the currently used engine control units are equipped, with respect to which units the engine control units according to the invention are only modified to a relatively small extent, remaining compatible as regards overall size and connection to the surrounding part of the system, and being geometrically interchangeable, such that building engine control units of a system according to the invention into currently equipped engines does not pose any problems.

To this end, the subject of the invention is an engine control system with motorized butterfly body, of the type comprising:

a motorized butterfly body, including at least one butterfly mounted so that it can rotate on a spindle in a duct of the body, at least one butterfly actuator which causes the rotation of the spindle of the butterfly and which is incorporated within the butterfly body, and at least one sensor for sensing the angular position of the butterfly, this also being incorporated within the butterfly body, a first electronic calculation and control unit, for controlling the butterfly, including at least one power circuit for operating the actuator of the butterfly, to which circuit the control unit of the butterfly is directly connected, and at least one circuit for automatically controlling the butterfly in terms of position, comparing a signal received from the sensor for sensing the angular position of the butterfly, to which the control unit of the butterfly is directly connected, with at least one reference signal about the position of the butterfly, and formulating, on the basis of an error signal resulting from the comparison, an order for regulating the position of the butterfly, which is transmitted to the power circuit, and a second electronic calculation and control unit for controlling the engine, connected to sensors for sensing operating parameters of the engine, from which it receives information relating at least to the rotational speed of the engine, the position of the shaft of the engine, and the pressure and/or flowrate of air in the intake manifold, and formulating orders for demanding injection and ignition, which it transmits to actuators of the fuel injection and ignition circuits of the engine, the operation of which it controls, the control unit of the engine transmitting information to the control unit of the butterfly, to which it is connected by a communication line, and is characterized in that the reference signal about the position of the butterfly is formulated within the control unit of the engine, on the basis of at least one signal about the position of the accelerator pedal delivered by at least one corresponding sensor to which the engine control unit is directly connected, the said reference signal being transmitted by the communication line to the control unit of the butterfly, which is directly built into the butterfly body so as to constitute a single assembly with it, the signal about the angular position of the butterfly being transmitted from the control unit of the butterfly to the engine control unit by the communication line.

Thus, the engine control unit provides, in the normal operating configuration, for the simultaneous control of the three circuits, namely air, fuel and ignition of the engine.

In an advantageous embodiment, the actuator of the motorized butterfly body is fitted directly on the spindle of the butterfly so that this spindle is common to the butterfly and to the actuator, which limits the number of parts used, and this actuator is an electric actuator with bipolar control, without a holding torque when it is not powered, which makes it possible to operate it in the direction of closure and in the direction of opening by means of an electrical order formulated in the control unit of the butterfly. What is more, the motorized butterfly body comprises at least one return spring, moving the butterfly in the direction of closure, when the actuator is no longer powered, the said return spring preferably closing the butterfly back to a position in which it is slightly open, corresponding to the engine operating at an accelerated low idle, allowing the vehicle to move along at a low speed. In the event of failure of the communication line or of the control unit of the butterfly, leading to a deactivation of the actuator, the return spring brings the butterfly back into a position which still allows the vehicle to move along, but at a low speed, as far as a garage or repair workshop.

In order to improve this facility, and while the engine of the vehicle is operating, an absence of activation of the actuator, corresponding to an order from the engine control unit or from the control unit of the butterfly, or any other cause, such as a breakdown in the communication line, and having as consequence a return of the butterfly to the accelerated low idle position, defined by the return spring, or to a neighboring position, leads to a correction in the moment of ignition and/or in the injection period, within the engine control unit, in order to limit the speed of the engine.

In order to improve safety, the control unit of the butterfly is directly connected to at least one braking sensor, so if the brake pedal is actuated, the control unit of the butterfly cuts off, possibly after a time delay, the supply to the actuator, the signal from the braking sensor being transmitted from the control unit of the butterfly to the control unit of the engine by the communication line.

With the same object of improving safety, particularly in the event of failure of the sensor for sensing the position of the accelerator pedal, the control unit of the butterfly is directly connected to at least one sensor for sensing the actuation of the accelerator pedal, which sensor is a contactor for sensing the actuation of this pedal or a second sensor for sensing the position of this pedal, in order to dissociate the signals coming from the accelerator pedal toward the engine control unit and toward the control unit of the butterfly, the signal from the sensor for sensing actuation of the accelerator pedal being transmitted from the control unit of the butterfly to the engine control unit by the communication line.

Still in order to improve safety, the control unit of the engine formulates, on the basis of the information which it receives mainly from the sensors for sensing the pressure and/or flowrate of air in the intake manifold and the speed of the engine, a signal about the reconstructed angular position of the butterfly, that at least one coherency-control procedure, implemented in the control unit of the engine, compares with the reference signal and/or with the signal from the sensor for sensing the angular position of the butterfly received from the control unit of the butterfly via the communication line, the reconstructed position signal being transmitted to the control unit of the butterfly by the communication line. Thus, in the event of failure of the sensor for sensing the position of the butterfly, the control unit of the butterfly can use the signal about the reconstructed position of the butterfly, this signal being sent by the engine control unit, and associated with automatic-control parameters designed to position the butterfly substantially with respect to the reference delivered by the engine control unit.

Furthermore, in order to take account of certain particular states of the vehicle and/or the value of certain physical quantities connected with the operation of the engine, in order to regulate the air circuit without only taking account of the demand from the driver expressed on the accelerator pedal, the control unit of the engine can substitute, at least partially, for the reference formulated on the basis of the signal received from a sensor sensing the position of the accelerator pedal, a reference corresponding to a programmed law, formulated taking account of at least one other signal, such as the engine speed, in order to set the low idle speed, and coming possibly from at least one additional sensor for sensing an operating parameter of the engine, such as the temperature of the cooling water of the engine, and/or from at least one other calculation and control unit of the vehicle, such as a unit for preventing wheelspin, a unit for preventing the wheels from locking up, a unit for controlling an automatic gear box, a unit for setting or limiting the speed of the vehicle, a unit for controlling the attitude of the vehicle, or even from at least one signal formulated by the engine control unit on the basis of operating parameters of the injection and ignition circuits, such as the quantity of fuel injected, the volume of air taken into the engine, or even the progressive nature of the movement of the accelerator pedal and/or the variation in engine torque under transient conditions.

In particular, the motor vehicle may be equipped with a system for setting the speed. In this case, it is advantageous for the signals for demanding the setting of speed, such as signals for starting/stopping the setting, for choosing the speed reference, braking, and/or clutch signals coming from the driver or from some other source and taken into account by the control unit of the engine, to be transmitted to it by the communication line from the control unit of the butterfly, which receives these signals by means of at least one clutch contactor, brake contactor, contactor for starting/stopping and/or choosing the speed reference. Thus, the control unit of the butterfly is used as an interface, via which information intended for the engine control unit passes, without it being necessary to reconfigure the connector of the latter in order to receive this information, because terminals for this purpose may be made available on the control unit of the butterfly, owing to the small number of connection terminals moreover necessary for connecting this control unit of the butterfly to the other components of the system.

As regards the communication line, this may be a parallel link, serial link, one or two-way one-conductor or twin-conductor line, or a two way line with one or more two wires in which the information flows in both directions according to defined sequencing and protocol, such as a so-called "VAN" or "CAN" protocol. However, preferably, this line is a two-way serial line comprising at least two electrical and/or optical conductors, each of which provides for a one way communication between the control unit of the engine and the control unit of the butterfly, it being possible for the serial line to comprise at least one additional conductor, transmitting clock signals between the two control units. In order to connect this line to the engine control unit, the terminals provided on the connector of an engine control unit of the state of the art may advantageously be used in order to operate the actuator for regulating the air flowrate for operating at low idle.

In order further to improve the operating safety of the system, each of the two control units implements self-diagnostic procedures and interactive diagnostic procedures which perform, within each unit, diagnostics on the inputs/outputs of the unit, of its calculations and of the information which it receives from the other unit via the communication line, the correct operation of which is checked by tests carried out in each of the control units by circuits for managing the said line and a communication protocol. For this purpose, each of the two control units directly receives enough signals to provide for the diagnostics, even if the communication line and/or the other control unit is defective. Such a configuration is advantageous because it makes it possible, in certain cases of a fault being diagnosed, to limit the extent to which the butterfly is opened by the engine control unit or by the control unit of the butterfly, made preferably so that it comprises at least one microcontroller providing at least for the automatic control of the butterfly in terms of position and the power control of the actuator, this microcontroller being incorporated into the butterfly body.

Preferably, moreover, each of the two control units comprises a microcontroller. It is then advantageous to make it so that in the case of a defect arising, the control unit of the butterfly directly demands the closure of the butterfly by means of an electrical control or deactivation of the actuator and/or in the case where the connection line is still operational, asks the engine control unit to modify and/or cut off the injection and/or the ignition. Symmetrically, in the case of a defect arising, the engine control unit may directly demand the modification and/or cutting-off of the injection and/or the ignition and/or, if the line is still operational, ask the control unit of the butterfly to close the butterfly again by electric control or by deactivating the actuator.

In order to reconstruct the angular position of the butterfly, as a variant to the embodiment explained hereinabove, a device for measuring the air flowrate may equally well be used in place of or in addition to the pressure sensor, and advantageously incorporated into the motorized butterfly body, and a corresponding signal may be transmitted by the communication line from the control unit of the butterfly to the engine control unit, which takes this signal into account together with the signal about the speed of the engine which it receives in order to formulate a signal about the reconstructed position of the butterfly.

When the injection installation is of the "single-point" type, comprising one injector, or possibly two injectors side by side, upstream of the butterfly in order to inject the fuel into the intake pipe, it is equally possible to incorporate into the motorized butterfly body a fuel supply circuit comprising the injector or injectors and a pressure regulator, the control for each injector then being transmitted, for example, in the form of digital signals from the engine control unit to the control unit of the butterfly by the communication line.

Other features and advantages of the invention will emerge from the description give herebelow, in a non-limiting way, of one embodiment example with reference to the single figure of the drawings which represents a block diagram of the system.

BRIEF DESCRIPTION OF THE DRAWING

The drawing is a block diagram of a preferred embodiment of the engine control system of the present invention.

DESCRIPTION OF THE PREFERRED EMBODIMENTS

The engine control system with motorized butterfly body, represented diagrammatically in the single FIGURE, comprises a block 1 including an electromechanical assembly made up of a motorized butterfly body 2, and an electronic calculation and control unit termed control unit of the butterfly 3.

The motorized butterfly body 2 comprises a butterfly body 4 proper, for example made of an aluminum alloy traversed by a duct in which a butterfly 5 is mounted so as to pivot on a spindle 6, as well as an actuator 7 for regulating the rotation of the butterfly 5, and a sensor 8 for sensing the angular position of the butterfly 5, the actuator 7 and the sensor 8 being directly incorporated into the butterfly body 4.

The actuator 7 is a rotary electrical actuator, fitted directly to the spindle 6 of the butterfly 5, so that this spindle 6 alone, supported by two ball bearings in order to provide for good accuracy and reduced friction, is provided for the actuator 7 and the butterfly 5 in order to limit the number of mechanical parts.

Although a stepper motor may be used, the actuator 7 is preferably a torque motor, having a stator with toric winding and permanent magnet rotor, without brushes, with a relatively large rotor/stator air gap (up to 0.8 mm) which facilitates fitting and limits the risks of the rotor becoming mechanically jammed in the stator, and without a residual holding torque when it is not powered. It is powered with direct current with a low electrical power consumption when stabilized, and can operate at low voltage (approximately 5.5 V) for positioning the butterfly 5 during start-ups. This torque motor is a motor with bipolar control, so that it can be controlled by an electric signal in the direction of opening and likewise of closing the butterfly 5, and allows an angular excursion of the butterfly 5 through 90°, over which excursion the torque motor exhibits a substantially constant torque, it being possible for this angular excursion to be traveled in a short time, for example of the order of 100 ms in one direction or the other, which is coherent with the response times of the engine and the kinematic chain of the vehicle. The choice of such a torque motor rather than a stepper motor makes it possible to obtain better angular resolution (better than 0.1°) for the position of the butterfly 5, at the same time as the safety feature of an absence of residual torque when the motor is not under voltage, as well as great ease of assembly and a high degree of simplicity and mechanical robustness, giving great reliability for a limited cost.

In the motorized butterfly body 2, a return spring (not represented) urges the butterfly 5 toward its position of closure and, when the actuator 7 is not powered, it returns the butterfly 5 to a position of rest which is a slightly open position, allowing the engine to operate at accelerated low idle, so that the vehicle can continue to move along but at a low speed. This position of rest of the return spring, which is not a position in which the butterfly is totally closed, may be obtained by a structure and an arrangement of a single return spring which gives it a negative then positive characteristic. As variant, two springs may be used which define a point of equilibrium corresponding to this position of rest with the butterfly 5 slightly open.

The sensor 8 for sensing the angular position of the butterfly 5 may be a Hall effect sensor, but preferably a potentiometer is chosen for recopying the angular position of the butterfly, it being possible for this potentiometer to be incorporated into the actuator 7.

Thus a motorized butterfly body 2 is obtained without an auxiliary air valve, having reduced bulk and weight, which is interchangeable with conventional butterfly bodies. Note that the motorized butterfly body 2 has two energy sources available, these being capable of closing the butterfly 5, under all the operating conditions of the engine, namely the electrical actuator 7 (the torque motor with bipolar control), and the return spring.

The electronic control unit 3 of the butterfly is directly built into the butterfly body 4. It comprises a power circuit 9 for controlling the actuator 7, to which this circuit 9 is directly connected, a microcontroller 10 with an analog-digital converter, preferably incorporated, which is directly connected to the sensor 8 for recopying the angular position of the butterfly 5, this microcontroller 10 providing particularly for the automatic control of the butterfly 5 in terms of position by comparing a signal received from the sensor 8 with a reference signal about the position of the butterfly (formulated and transmitted to the control unit 3 of the butterfly under conditions specified hereafter) and formulating, on the basis of an error signal resulting from the comparison, an order for regulating the angular position of the butterfly, which order is transmitted to the power circuit 9 possibly via an intermediate stage 11, which is an interface stage between the power stage 9 and the microcontroller 10, and provides for the shaping of the control signals.

In the power stage 9, the power is delivered by an H-shaped bridge controlled by a pulsating signal with pulse width modulation, so that when the output from the microcontroller 10 remains jammed, the H-shaped bridge is deactivated. The movements of the butterfly 5 are controlled and monitored by a closed automatic-control loop of the proportional, integral and derivative type, supplying sufficient resolution, better than 0.1°, in order to provide for the setting of low idle speed. The control unit 3 of the butterfly also comprises an electric power supply unit 12, connected by conductive wires 13 and 14 to a battery (not represented) and powering, on the one hand, the power stage 9, and, on the other hand, at different voltages, the microcontroller 10, the shaping stage 11, and the potentiometer 8 for recopying the angular position of the butterfly. The signal from this potentiometer 8 is read solely by the microcontroller 10 built into the motorized butterfly body 2, which avoids interference. The control unit 3 of the butterfly also fulfills other functions, which are mentioned hereafter.

The system comprises an electronic calculation and control unit 15, termed engine control unit, also produced in the form of a microcontroller and with an incorporated analog-digital converter. As regards its internal architecture, this engine control unit 15 exhibits only limited modifications compared with that of standard engine control computers and, in particular, it is equipped with a connector identical to that of a standard engine control computer and exhibits the same geometric shape and the same overall size. The engine control unit 15 is connected, at 16, to sensors for sensing operating parameters of the engine, which sensors are represented diagrammatically at 17, and detect, at 18, signals about the engine speed and about the position of the shaft of the engine, at 19, signals about the air pressure in the intake manifold, and at 20, signals about the temperature of the cooling water of the engine. On the basis of these signals, the unit 15 formulates orders for controlling injection and ignition, which it transmits at 21 to actuators, represented diagrammatically at 22, for the fuel injection and ignition circuits of the engine, the operation of which it controls and monitors. In particular, the unit 15 determines the moments and periods of injection, which, taking account of a fuel supply pressure, also makes it possible to determine the quantities of fuel injected, and it transmits the corresponding control orders to the winding of the injectors, at 23, and to the fuel pump, at 24. Simultaneously, the unit 15 defines the moments and energy for ignition and transmits corresponding control signals to the ignition coils at 25.

The engine control unit 15 also receives, at 26, a signal about the angular position of the accelerator pedal 27, which it receives from at least one angular position sensor 28, which is, for example, a potentiometer for recopying the angular position of the pedal 27. This sensor 28 may be incorporated into the accelerator pedal 27, or separate from this pedal 27 and connected to the latter by a cable. In both cases, the sensor 28 has two return springs.

The accelerator pedal 27, which may as an option exhibit a hard spot for the function known as "kick down", is also associated with a sensor 29 for sensing actuation of this pedal which is, for example, a multicontactor termed "foot off" contactor sensitive to the actuation of the pedal 27, but which may be a second sensor for sensing the angular position of this pedal 27, for example a second potentiometer, and this sensor 29 is directly connected by the conductor 30 to the control unit 3 of the butterfly, so as to dissociate the signals coming from the accelerator pedal 27 toward, on the one hand, the engine control unit 15 and, on the other hand, the control unit 3 of the butterfly. The latter unit is also directly connected to a braking sensor which, in this example, is a contactor 32 for the actuation of the brake pedal 31, and connected to the control unit 3 of the butterfly by the conducting wire 33.

In parallel with the conductor 33, the control unit 3 of the butterfly is connected by at least one conducting wire, and for example by four conducting wires 34 to 37, to the control unit 38 for controlling the function of setting the speed of the vehicle, the conductor 34 for example being connected to a contactor for starting/stopping this system, the conductor 35 being connected to a clutch contactor or automatic gear box contactor, and the conductors 36 and 37 respectively to contactors for storing the chosen speed in memory and for retrieving this information from memory, for choosing the speed reference for the vehicle. In addition, by means of the conducting wire 39, the control unit 3 of the butterfly is connected to a warning lamp indicating the operation of the system for setting the speed.

The two control units 3 and 15 are connected to one another via a communication line 40 via which they exchange information, and which may be of various types. Advantageously, however, a two way serial line is used comprising at least two conducting wires 41 and 42, the first of which transmits information from the engine control unit 15 to the control unit 3 of the butterfly, and the second provides for the transmission of information in the opposite direction. These conductors 41 and 42, each of which provides for one way communication between the control units 3 and 15, are electrical conductive wires, but may be conductors with optical fibers if each of the two control units 3 and 15 is equipped with an appropriate optoelectronic converter. This line 40 advantageously comprises at least one additional conductor 43, which transmits clock signals between the two control units 3 and 15. As a variant, for a reason of safety, the two way serial line 40, limited to the two conductors 41 and 42, may be twinned, which makes it possible to use, for connecting the line 40 to the engine control unit 15, terminals available on the connector with which conventional engine control units are equipped, in order to connect them up to the actuator of the auxiliary air regulator valve of butterfly bodies of the state of the art. This facility further increases the benefit of using, as engine control unit 15 of the invention, a control unit which is as little modified as possible by comparison with that of the state of the art, of which the terminals available on the connector with which they are equipped are thus used, without it being necessary to fit additional connectors.

Each of the two control units 3 and 15 comprises a stage for managing the exchange of information with the outside of the unit in question, according to a procedure providing for the coherency of the signals received and transmitted, and manages the serial communication line 40, the correct operation of which is monitored by tests carried out in each of the units 3 and 15 and the communication protocol. Each of the control units 3 and 15 thus advantageously incorporates the functions of management and of processing, of input/output, namely the serial interface functions, and includes appropriate memories.

By means of the serial line 40, the two control units 3 and 15 exchange information: the control unit 3 of the butterfly transmits to the engine control unit 15 in particular the signals about the angular position of the butterfly 5, which it receives from the sensor 8, from the "foot off" contactor 29 associated with the accelerator pedal 27, and from the contactor 32 for actuation of the brake pedal 31, as well as the signals which come to it originating from the control unit 38 for controlling the function of setting the speed of the vehicle, that is to say signals for starting/stopping this function, actuating the clutch or the automatic gear box, and storing in or retrieving from memory the speed reference chosen for the vehicle. These signals for controlling the setting of speed, originating from the control unit 38, and intended to be taken into account by the engine control unit 15, pass through the control unit 3 of the butterfly and through the serial line 40 only because it is more advantageous to build corresponding connection terminals into the connector for the unit 3, whereas direct connection of the lines 34 to 39 to the engine control unit 15 would require its connector to be reconfigured. What is more, the control unit 3 of the butterfly, and likewise the engine control unit 15, implements self-diagnostic and interactive diagnostic procedures which, in each unit, perform diagnosis on the inputs/outputs of the unit, on its calculations and on the information which it receives from the other unit via the serial line 40. Consequently, the unit 3 transmits to the unit 15, via the line 40, self-diagnostic information about the motorized butterfly body 2 and about the unit 3, as well as a message for validating the communication.

In the opposite direction, the engine control unit 15 transmits to the unit 3 a reference signal about the position of the butterfly, which it formulates, a signal about the reconstructed angular position of the butterfly, which it also formulates, in order to drive the butterfly 5, effect calculations and implement necessary coherency procedures, proceed with the diagnostics and, if need be, apply emergency measures defined hereafter, as well as a signal controlling the warning lamp witnessing the operation of the system for setting speeds 38, and which the unit 3 retransmits to this warning lamp via the conducting wire 39, and also information connected with the self-diagnostics of the engine control unit 15 as well as messages for validating the communication.

In the engine control unit 15, formulation of the signal about the reconstructed angular position of the butterfly is provided for mainly on the basis of signals about the air pressure in the intake manifold and about the engine speed, which the unit 15 receives from the corresponding sensors. The unit 15 implements a coherency monitoring procedure, which compares with each other the signal about the angular position of the butterfly, received by the line 40 from the unit 3, the signal about the reconstructed angular position of the butterfly, and the reference signal which it formulates and, possibly, the signal about the position of the accelerator pedal 27, received from the sensor 28. Likewise, the control unit 3 of the butterfly implements a coherency monitoring procedure comparing with each other the signal about the angular position of the butterfly, which it receives directly from the sensor 8, and the signals about the reference and reconstructed angular position of the butterfly, which it receives via the serial line 40 from the engine control unit 15.

As a variant, a signal about the intake air flowrate is substituted for the signal about the air pressure in the intake manifold, and combined mainly with the signal about the engine speed in order to obtain the signal about the reconstructed angular position of the butterfly. In this case, a volume-flow meter, for example of the hot film or hot wire type, may be incorporated into the motorized butterfly body 2 and the intake air flowrate signal may, in this case, be read by the control unit 3 of the butterfly and transmitted via the serial line 40 to the engine control unit 15.

As mentioned hereinabove, another function of the engine control unit 15 is to calculate the angular position which the butterfly 5 is to assume, that is to say to formulate a reference about the position of the butterfly, simultaneously with managing the injection and ignition. This reference signal about the position of the butterfly is given by an accelerator pedal 27/butterfly 5 programmed transfer law which takes into account, in "pedal-following" mode, that is to say as a function of the demand transmitted by the driver via the accelerator pedal 27, essentially the signal about the position of this pedal provided by the potentiometer 28, this reference law may also take account of other parameters, such as the speed of the vehicle in "speed setting" mode and, possibly, signals coming from other onboard computers such as those of a system for preventing wheelspin, preventing the wheels from locking up, or from a gear box or an electronically controlled transmission, the signals from which may be transmitted directly to the engine control unit 15 by the connection wires 44 to 46 respectively, or alternatively transmitted to the control unit 3 of the butterfly which retransmits them to the engine control unit 15 by the serial line 40.

The reference law also takes account of certain operating conditions of the engine, such as the water temperature of the coolant and the speed of the engine, particularly in the "setting the low idle speed" mode. This reference law also takes account of strategies adopted as regards comfort, and takes account of weighting factors in order to introduce a progressiveness in the angular movement of the butterfly 5 with respect to the travel of the accelerator pedal 27 and to apply dynamic corrections to the butterfly. Another strategy taken into account may be a strategy of preventing pollution and reducing consumption, by synchronized management of the air taken in and of the quantity of fuel injected. What is more, formulation of the reference law about the position of the butterfly is also provided for on the basis of the state diagnosed by the unit 15.

To sum up, this engine control unit 15 essentially provides for the following functions: formulation of the reference about the position of the butterfly, as mentioned hereinabove, on the basis of at least one signal representing a physical input quantity and/or a state of the system, or of an associated system, the self-diagnostics and the interactive diagnostics with the other control unit 3 of the butterfly, the application of emergency measures if need be, and the management of the serial line 40. In the event of a fault being diagnosed, the unit 15 may operate an indicator warning light by means of the conducting wire 47.

For its part, the control unit 3 of the butterfly, in addition to the functions already mentioned of managing the serial line 40, acquiring the inputs necessary for the operation of the system for setting the speed and of transmitting corresponding signals via the line 40 to the other unit 15, of self-diagnostics and interactive diagnostics with this unit 15, and applying emergency measures, fulfills the other essential functions which are the application of the reference signal about the position of the butterfly, which it receives from the unit 15 via the line 40, in order to automatically control the butterfly 5 in terms of position, so as to position the latter precisely on the reference delivered by the engine control unit 15, and the initialization of the position of the butterfly 5 with a check when it is switched on.

When one and/or the other of the units 3 and 15 diagnoses a failure or when the implementation of the coherency procedures reveals a discrepancy between the signals formulated in the unit in question and/or received from sensors connected to this unit, with signals received from the other unit through the serial line 40, emergency measures are applied by one and/or the other of the two units 3 and 15, depending on the extent of failure or of discrepancy. Strategies of emergency measures are applied gradually depending on the fault diagnosed in order to preserve the safety of the passengers, whilst allowing the vehicle to be able to continue to move along at a low speed, except in the event of danger, which may lead to the operation of the engine being stopped.

In the emergency mode, the progressive action, as a function of the origin and severity of the failure, may start off with a limited intervention on a secondary function, for example preventing operation in the mode wherein the vehicle speed is set. This may continue on into a limitation in the maximum extent to which the butterfly 5 is opened, demanded by the engine control unit 15 or by the control unit 3 of the butterfly in certain cases of diagnosed fault. The emergency measure applied may also consist in an electrical demand to close the butterfly 5 again, which demand may originate from one and/or the other of the two units 15 and 3. An emergency measure also consists in deactivating the actuator 7 of the butterfly 5, preserving a mechanical function still allowing the vehicle to move along at a slow pace. This absence of activation of the actuator 7 may correspond to an electrical order originating from the engine control unit 15 or from the control unit 3 of the butterfly, and may be caused by a break in the serial line 40 or a failure of the unit 15. Its consequence is to return the butterfly 5 to the accelerated low idle position, under the action of the return spring, or to a neighboring position, and it leads, within the engine control unit 15, to a correction of the moment of ignition and/or injection, in order to limit the speed of the engine.

In the event of danger, separate paths make it possible to decrease the power of the engine, even if the serial line 40 is cut. On the one hand, the engine control unit 15 may demand the cut-off of injection and/or ignition and, on the other hand, the butterfly 5 may be closed, this being by two means, either electrically by a demand from the engine control unit 15 or from the control unit 3 of the butterfly, or mechanically by the return spring, after deactivation of the stage 9 of power control of the actuator 7.

The engine control unit 15 may then demand modification or cut-off of the injection and/or ignition, in order to decrease the power of the engine, when a failure in the serial line 40 is detected, and when it detects that a fault has arisen which may lead to the driver losing control over the power of the engine.

The powering of the actuator 7 may also be cut off, possibly after a time delay, by the control unit 3 of the butterfly, when the brake pedal 31 is actuated.

It is thus noticed that the architecture of the system allows overall management of the engine, by its three circuits, namely of air supply, fuel supply, and ignition, by means of the engine control unit 15 alone which is thus capable of acting very rapidly and simultaneously on these three circuits, as required. The incorporated unit 1, associating with the motorized butterfly body 2 the electronic control unit 3 of the butterfly, is thus such that the motorized butterfly body 2 behaves as an intelligent actuator as regards the engine control unit 15, with which the control unit 3 of the butterfly is in a master-slave relationship.

The system exhibits a high degree of reliability and guarantees a maximum amount of safety in the event of failure, owing to the safety features connected with the components, as have been described hereinabove, the safety features connected to the architecture of the system, as explained hereinabove, and the redundancies of the system.

In particular, each control unit 3 and 15 receives enough information to provide for sufficient self-diagnostics, even in the event of disturbances in or cutting of the serial line 40 and/or if the other control unit is defective.

In addition, the system offers two separate means for monitoring the position of the butterfly 5. The first means is the sensor 8, such as a potentiometer on the spindle of the butterfly, the signal from which is read directly by the control unit 3 of the butterfly and transmitted via the line 40 to the engine control unit 15, and the second means is the signal about the reconstructed angular position of the butterfly, this signal being calculated by the engine control unit 15 particularly on the basis of the speed of the engine and either the air pressure at intake, or the air flowrate at intake. Note that in the event of failure of the sensor 8 for sensing the position of the butterfly 5, the control unit 3 of the butterfly may use the signal about the reconstructed position of the butterfly, which it receives via the line 40 from the engine control unit 15, and associate it with automatic-control parameters designed to substitute it for the signal about the detected position of the butterfly in order to provide for the automatic control of the latter in terms of position, that is to say so as to position the butterfly substantially with respect to the reference delivered by the engine control unit 15, possibly with impaired performance, but performance which remains sufficient for acceptable driving of the butterfly 5.

The system also offers two separate means for monitoring the demand of the driver. The first means is the sensor 28 or potentiometer for recopying the angular position of the accelerator pedal 27, the signal from which is read directly by the engine control unit 15, and the second means is the "foot off" contactor 29, or second potentiometer, also sensitive to the actuation of the accelerator pedal 27, and the signal from which is read directly by the control unit 3 of the butterfly, but retransmitted by the line 40 to the engine control unit 15. Consequently, in the event of failure of the sensor 28 for sensing the angular position of the accelerator pedal, the engine control unit 15 still has available, by means of the control unit 3 of the butterfly and the contactor 29, information about the actuation of the accelerator pedal 27.

In addition, it is noticed that these redundancies and this safety feature are obtained without it being necessary to duplicate the sensors for sensing the operating parameters of the engine used. What happens is that the signals necessary for the operation of each of the two control units 3 and 15, and originating from sensors to which this unit is not directly connected, arrive at this unit by passing through the other control unit and the serial line 40. It is also noticed that each of the two control units 3 and 15 may be used as an interface in order to send to the other unit information originating from outside the system or from an associated system or, in the contrary sense, in order to send out toward the outside or toward an associated system information originating from this other control unit.

In addition to the accelerator pedal/butterfly programmable transfer law, a major benefit of the system according to the invention is that the distribution of the functions over two separate microcontrollers, with mutual surveillance tests, gives access to a great number of achievable functions, some of which are novel, and which may be classified into two categories depending on whether they act on the control of the engine or whether they act on the control of the vehicle.

In the first category, in order to arrive at the objective consisting in the metering of the power of the engine and to optimize its operation, particularly in terms of emissions of pollutants and in terms of consumption, there can be incorporated into the accelerator pedal/butterfly programmable transfer law the prepositioning of the butterfly for starting, particularly cold starting, setting the low idle speed, for example as a function of the water temperature, as well as functions of damping out the angular movements of the butterfly, following the richness of the air/fuel mixture under transient conditions, and limiting the speed of the engine.

The functions belonging to the second category are those via which controlling the position of the butterfly produces consequences as regards the vehicle, in order to improve comfort, pleasure in driving and safety. These functions are functions of setting and/or limiting the speed of the vehicle, regulating the butterfly to prevent wheelspin and/or for antilocking functions, reducing jerkiness, and interactions with an electronic gear box, an anticollision system, a guiding system and/or a system for controlling the attitude of the vehicle, for example under cornering, such as an active suspension system.

In order to produce the engine control unit according to the invention, the architecture of an engine control unit of the state of the art may essentially be preserved, the terminals of the connector for operating the actuator of the auxiliary air supply circuit in a conventional engine control unit being used, in the system according to the invention, for connecting the serial line 40 to the engine control unit 15, the control electronics of which, by comparison with those controlling the auxiliary air circuit in a conventional unit, are extended to the entire dynamic range of the butterfly (for example from 0 to 400 kg of air per hour).

The system described hereinabove with reference to the single figure is particularly suited to injection installations of the multi-point type, that is to say including at least one injector for each cylinder of the engine, and providing for injection downstream of the butterfly body, in the downstream end of the injection pipe, in the immediate vicinity of the cylinder head of the engine. If the device is to be suited to injection of the single-point type, then the single injector or the two side by side injectors is or are fitted incorporated directly into the butterfly body 4, so as to inject the fuel directly upstream of the butterfly 5, and the pressure regulator for supplying the injector or injectors is also built into this body 4.

We claim:

1. An engine control system for a spark-ignition internal combustion engine of a vehicle equipped with a fuel injection system, comprising:

an integrated assembly including:

a motorized butterfly unit, having a butterfly body including: a) a duct and a spindle, b) at least one butterfly rotatably mounted on said spindle in said duct of said body, c) at least one first actuator for actuating said butterfly by controlling rotation of said spindle, and d) at least one first sensor for sensing a butterfly angular position, and wherein said first actuator and said first sensor are incorporated within said butterfly body;

a first electronic calculation and control unit (ECCU) for controlling said butterfly, said first ECCU being directly built into said butterfly body and including: a) at least one power circuit for operating said first actuator and directly connected to said first actuator, b) at least one control circuit for automatically controlling said butterfly angular position, said control circuit directly connected to said first sensor; said control circuit receiving a butterfly angular position signal from said first sensor, comparing said butterfly angular position signal with at least one butterfly angular position reference signal corresponding to a desired angular position of said butterfly, and formulating, on the basis of an error signal resulting from the comparison, control signals for regulating said butterfly angular position, which control signals are transmitted to said power circuit;

an interface stage between said power circuit and said control circuit, said interface stage providing for shaping of said control signals; and an electric power supply unit for powering at least said power circuit, said control circuit, and said first sensor;

second sensors for sensing operating parameters of said engine including engine rotational speed, engine shaft position, engine cooling water temperature, and at least one parameter chosen from a group comprising intake manifold air pressure and intake manifold air flowrate;

second actuators for actuating fuel injection and ignition circuits of the engine;

a second ECCU, connected to said second sensors and to said second actuators, for controlling said engine by transmitting, via said second actuators, on the basis of signals received from said second sensors, orders for controlling fuel injection and ignition to injector windings, to a fuel pump, and to ignition coils of said vehicle, said second ECCU further formulating said butterfly angular position reference signal, as well as a reconstructed butterfly angular position signal, said reconstructed butterfly angular position signal being formulated on the basis of an engine rotational speed signal and of a signal chosen from the group comprising intake manifold air pressure and intake manifold air flowrate, received from said second sensors;

a third sensor, directly connected to said second ECCU, for sensing the angular position of an accelerator pedal of the vehicle and transmitting an accelerator pedal angular position signal to said second ECCU, said second ECCU formulating said butterfly angular position reference signal based on said accelerator pedal angular position signal;

a fourth sensor, for sensing actuation of said accelerator pedal, being one of a contactor sensitive to the actuation of said accelerator pedal or an additional sensor for sensing the angular position of said accelerator pedal, said fourth sensor being directly connected to said first ECCU so as to dissociate the signals coming from said accelerator pedal toward said first ECCU via said fourth sensor, and toward said second ECCU via said third sensor;

a fifth sensor for sensing actuation of a brake pedal of the vehicle being directly connected to said first ECCU; and a communication line interconnecting said first and second ECCUs, said first and second ECCUs exchanging information via said communication line, said information including signals from said first, fourth and fifth sensors transmitted from said first to said second ECCU as well as said butterfly angular position reference signal and said reconstructed butterfly angular position signal transmitted from said second to said first ECCU.

2. A system according to claim 1, wherein said first actuator is an electrical actuator, with two-pole control, without holding torque when not powered.

3. A system according to claim 1, wherein said first actuator is fitted directly on said spindle, so that said spindle is common to said first actuator and to said butterfly.

4. A system according to claim 1, wherein said motorized butterfly unit further comprises at least one return spring, urging said butterfly, when said first actuator is not powered, to an accelerated low idle position, which is a slightly open position corresponding to said engine operating at accelerated low idle.

5. A system according to claim 1, wherein an absence of activation of said first actuator, while said engine is operating, corresponding to an order from at least one of said first and second ECCUs, and being caused by a breakdown in said communication line, causes a return of said butterfly to said accelerated low idle position, under the action of said return spring, or to a neighboring position, and leads, within said second ECCU, to a correction of the timing of either ignition or injection, or both, in order to limit the speed of said engine.

6. A system according to claim 1, wherein if said brake pedal is actuated, said first ECCU cuts off the supply to said first actuator and a signal from said fifth sensor is transmitted from said first ECCU to said second ECCU via said communication line.

7. A system according to claim 1, wherein said second ECCU implements a coherency monitoring procedure, comparing said butterfly angular position signal, which it receives from said first ECCU via said communication line, with said reconstructed butterfly angular position signal and said butterfly angular position reference signal, which it formulates.

8. A system according to claim 1, wherein said first ECCU implements a coherency monitoring procedure, comparing said butterfly angular position signal, which it receives directly from said first sensor, and said reconstructed butterfly angular position signal and said butterfly angular position reference signal, which it receives from said second ECCU via said communication line.

9. A system according to claim 1, wherein said second ECCU further transmits a plurality of drive system signals including signals for preventing wheelspin, signals for preventing the wheels from locking up, signals for a gear box or an automatically controlled transmission of said vehicle, and signals for a system for controlling the attitude of said vehicle, said second ECCU formulating said butterfly angular position reference signal on the basis of a programmed law which takes into account, in addition to said accelerator pedal angular position signal, at least one other signal chosen from the group comprising: signals representing the vehicle speed, said drive system signals, said signals provided by said second sensors, signals corresponding to a progressive nature of the movement of said accelerator pedal, and signals representing a volume of air taken in and an amount of fuel injected into said engine.

10. A system according to claim 1, further comprising:

a control unit for controlling the function of setting the speed of said vehicle, at least one first contactor for starting and stopping said setting, a second contactor for actuating a clutch or automatic gear box of said vehicle, a third contactor and a fourth contactors for choosing a speed reference for said vehicle, said control unit being directly connected to said first ECCU, and receiving signals including signals from said first, second, third, and fourth contactors, said signals as well as a signal from said fifth sensor being transmitted to said second ECCU via said first ECCU and said communication line, in order to set the speed of said vehicle.

11. A system according to claim 1, wherein said communication line is chosen from among the group comprising: parallel and serial communication lines, one-way and two-way one-conductor or twin-conductor communication lines, and two-way communication lines with one or two wires in which information flows in both directions according to defined sequencing and protocol.

12. A system according to claim 11, wherein said communication line is a two-way serial line comprising at least two conductors, each of which provides for a one-way communication between said first and second ECCUs, and at least one additional conductor, transmitting clock signals between said first and second ECCUs.

13. A system according to claim 1, wherein each of said first and second ECCUs implements self-diagnostic and interactive diagnostic procedures which, in each unit, perform diagnosis on the inputs/outputs of said unit, on its calculations and on the information which it receives from the other unit via said communication line, the correct operation of which is checked by tests carried out in each of said ECCUs by circuits for managing said line and a communication protocol.

14. A system according to claim 13, wherein each of said first and second ECCUs receives enough information to provide for said self-diagnostic procedures, even if at least one of said communication line and the other ECCU is defective.

15. A system according to claim 13, wherein, if a fault is diagnosed by said first ECCU, said first ECCU directly demands the closure of said butterfly by means of either an electrical control or a deactivation of said first actuator, and if said communication line is still operational, said first ECCU asks said second ECCU to modify at least one of the injection and ignition of said engine.

16. A system according to claim 13, wherein, if a fault is diagnosed by said second ECCU, said second ECCU directly demands the modification of at least one of the injection and ignition of said engine, and if said communication line is still operational, asks said first ECCU to close said butterfly by means of either an electric control or a deactivation of said first actuator.

17. A system according to claim 1, wherein said first ECCU comprises at least one first microcontroller, in said circuit for automatically controlling said butterfly angular position, and said second ECCU comprises at least one second microcontroller.

18. A system according to claim 1, wherein, in the event of a failure of said first sensor, said first ECCU uses said reconstructed butterfly angular position signal, and associates it with automatic-control parameters designed to substitute it for said butterfly angular position signal, in order to regulate said angular position of said butterfly substantially with respect to said angular position reference signal delivered by said second ECCU.

19. A system according to claim 1, wherein the extent to which said butterfly is opened is limited by one of said first and second ECCUs when at least one fault has been diagnosed.

20. A system according to claim 1, wherein said motorized butterfly unit further comprises a device for measuring the intake air flowrate, which is incorporated therein, said device providing an intake air flowrate signal which is transmitted via said communication line from said first to said second ECCU, which combines said intake air flowrate signal with a signal representing said engine rotational speed to formulate said reconstructed butterfly angular position signal.

21. A system according to claim 1, for an engine equipped with an injection system of the "single-point" type, wherein said butterfly unit further comprises a fuel supply circuit including at least one injector and a pressure regulator, a control signal for each of said injectors being transmitted from said second to said first ECCU via said communication line.

* * * * *